US006074027A

United States Patent [19]

Chang

[11] Patent Number: 6,074,027

[45] Date of Patent: Jun. 13, 2000

[54] COMBINATION TYPE ANTIQUE DISPLAY SHELF

[75] Inventor: Thomas Chang, Taipei, Taiwan

[73] Assignee: Collins Co., Ltd., Taipei, Taiwan

[21] Appl. No.: 09/181,883

[22] Filed: Oct. 29, 1998

[51] Int. Cl.[7] ..... A47B 87/00

[52] U.S. Cl. ..... 312/108; 312/140; 312/265.5; 312/117

[58] Field of Search ..... 312/108, 107, 312/111, 109, 114, 117, 138.1, 140, 351, 258, 262, 265.1, 265.2, 265.3, 265.4, 265.5, 265.6, 257.1, 263; 16/268, 267, 262; 108/91

[56] References Cited

U.S. PATENT DOCUMENTS

| | | | |
|---|---|---|---|
| 645,549 | 3/1900 | Carico | 312/108 |
| 4,232,916 | 11/1980 | Correia | 312/265.5 X |
| 4,747,644 | 5/1988 | Gallery et al. | 312/262 X |
| 5,383,722 | 1/1995 | Chen | 312/334.44 X |

FOREIGN PATENT DOCUMENTS

| | | | |
|---|---|---|---|
| 3025962 | 2/1982 | Germany | 312/265.5 |
| 3716341 | 1/1988 | Germany | 312/263 |
| 137899 | 1/1920 | United Kingdom | 312/107 |
| 604344 | 7/1948 | United Kingdom | 312/262 |

*Primary Examiner*—Janet M. Wilkens
*Attorney, Agent, or Firm*—Bacon & Thomas, PLLC

[57] ABSTRACT

A combination type antique display shelf, with a first plate body, a first frame body, a middle placement plate body, a second frame body and a second plate body. The first plate body is fixed by screws to the bottom of the first plate body to form a base. The top of the first frame body is fixed by screws to the bottom of the second frame body, and the middle separating plate body is fixed by screws to the inside of the joint of the first frame body and the second frame body, to serve as a middle separating plate. Finally, the second plate body is fixed by screws to the top of the second frame body, to serve as a top plate. Conventional window glass are fitted to the frames and the display shelf is completed.

3 Claims, 12 Drawing Sheets

COMBINATION TYPE ANTIQUE DISPLAY SHELF

BACKGROUND OF THE INVENTION

1. Field of the Invention

The invention relates to a combination type antique display shelf, particularly to a structure that can be easily disassembled or assembled.

2. Description of the Related Art

In the modern-day ever-advancing society, we have seen changing technology, but as far as antique collectors are concerned, tthe age of the antique is what counts. Appreciation of antiques has gradually become part of leisure and recreational life of most modern people, and the display of antiques has become a part of their lives.

Therefore, a shelf for the display of antiques is an essential consideration of antique collectors, but regular antique display shelves can either be ordered or ready made by a furniture store, but its display shelf body is fixed as an integral party that cannot be disassembled or assembled by users. As a result, conventional display shelves involve the following inconveniences and shortcomings:

1. When antiques or the display shelf must be relocated to a far distance, the bulky size of the entire display shelf makes handling very difficult, and its window glass can be damaged.
2. When antique display shelf is not in use, it could not easily be disassembled for storage in order to save space.

In view of the above shortcomings, there is a need for a combination type antique display shelf that overcomes the above described shortcomings of the prior art.

SUMMARY OF THE INVENTION

The primary objective of the present invention is to present an antique display shelf that can be easily disassembled or assembled.

Another objective of the invention is to present a combination type antique display shelf with a solid construction, in addition to the feature of easy assembly.

The invention includes a first plate body, a first frame body, a middle placement plate body, a second frame body and a second plate body. The first plate body can be fixed by screws to the base of the first frame body, so that the first plate body serves as a base, and the top of the first frame body is fixed by screws to the base of the second plate body, while the middle placement plate body can be located at the joint of the first frame body and the second frame body, and fixed by screws to the inside of the top of the first frame body or the inside of the base of the second frame body, so it serves as a middle separating plate. The second plate body is fixed by screws to the top of the second frame body, so it serves as a top plate. Regular window glass is to be fitted between the frames of the frame bodies to complete a display shelf.

BRIEF DESCRIPTION OF THE DRAWINGS

To further enable the understanding of the detailed characteristics and construction of the invention, a preferred embodiment of the invention is shown in the following drawings.

DETAILED DESCRIPTION OF THE PREFERRED EMBODIMENT

Figure 1:
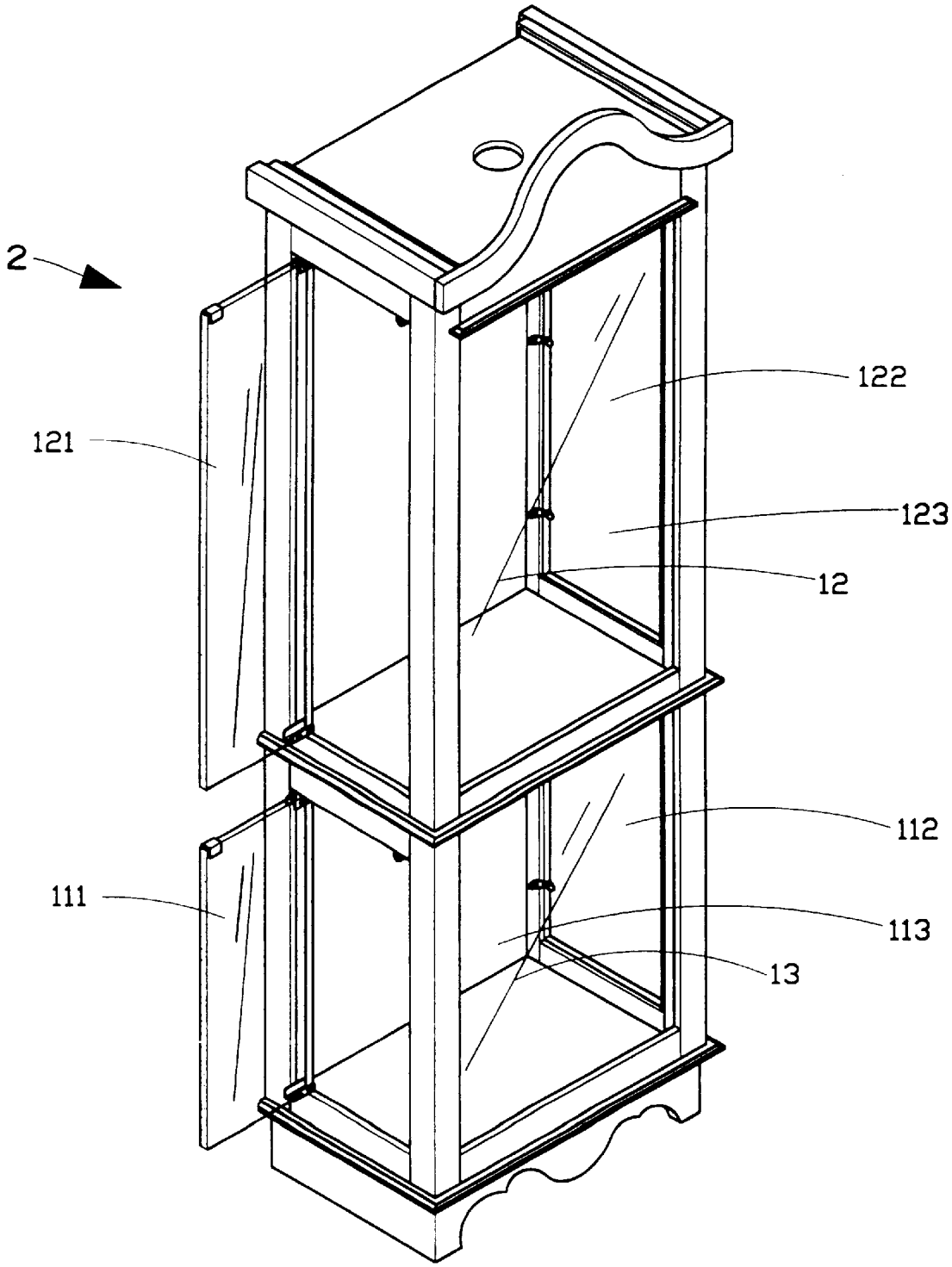
FIG. 1 is a perspective view of the invention of display shelf.

First, please refer to FIG. 1 which is a perspective view of the invention of display shelf. The present invention of a display shelf involves a shelf frame body 2 as its essential part and includes a first display space 13 and a second display space 12, wherein, on the right side of the first display space 13 is installed a first glass door 111, and on its left side and front side are respectively installed a first left window glass 112 and a first front window glass 113. On the right side of the second display space 12 is installed a second glass door 121, and on its left side and front side are respectively a second left window glass 122 and a second front window glass 123, and on the back side of the shelf frame body 2 can be installed a mirror glass (not shown in drawing).

Figure 2:
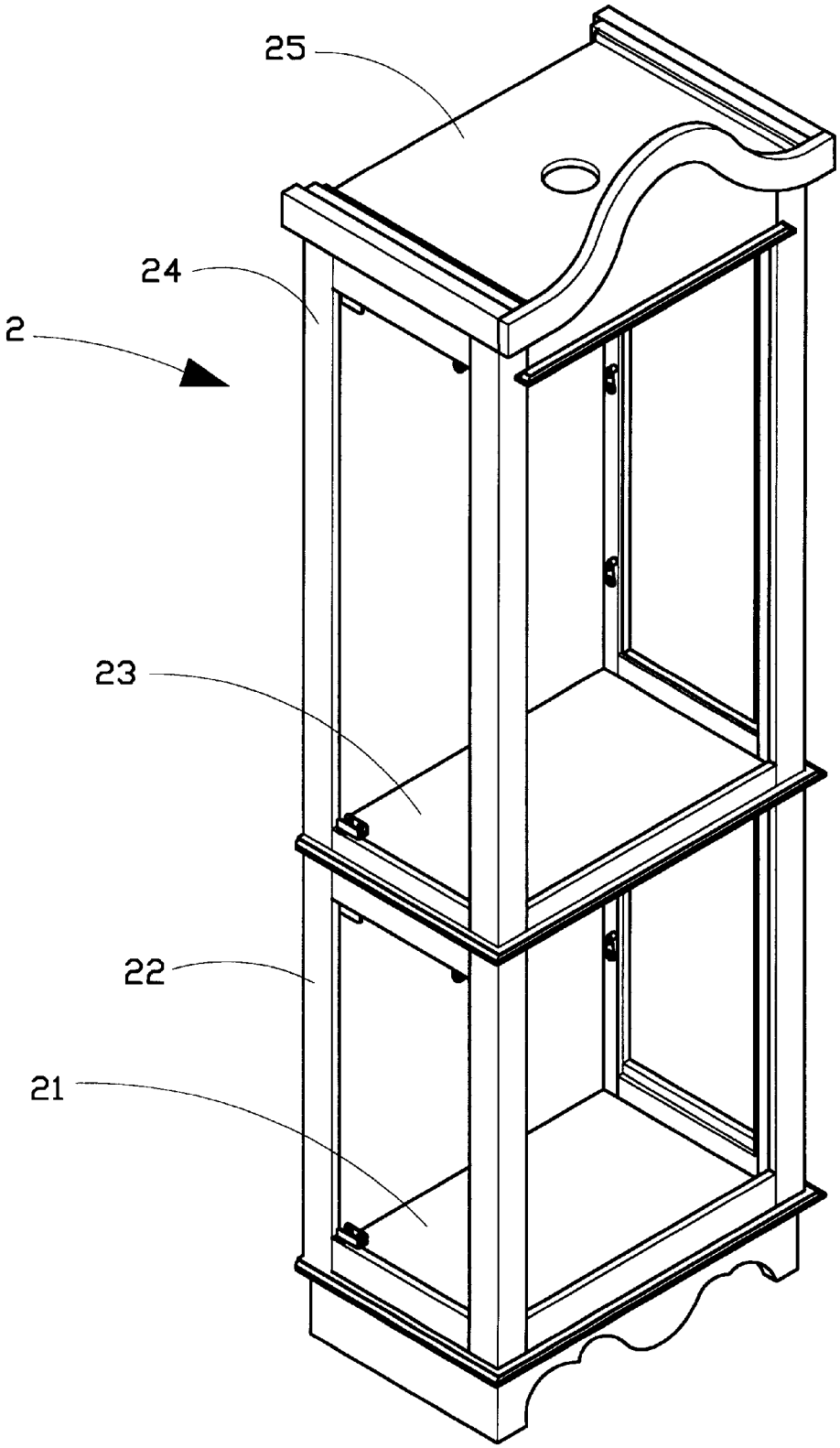
FIG. 2 is a perspective view of the shelf frame body of the invention.
Figure 3:
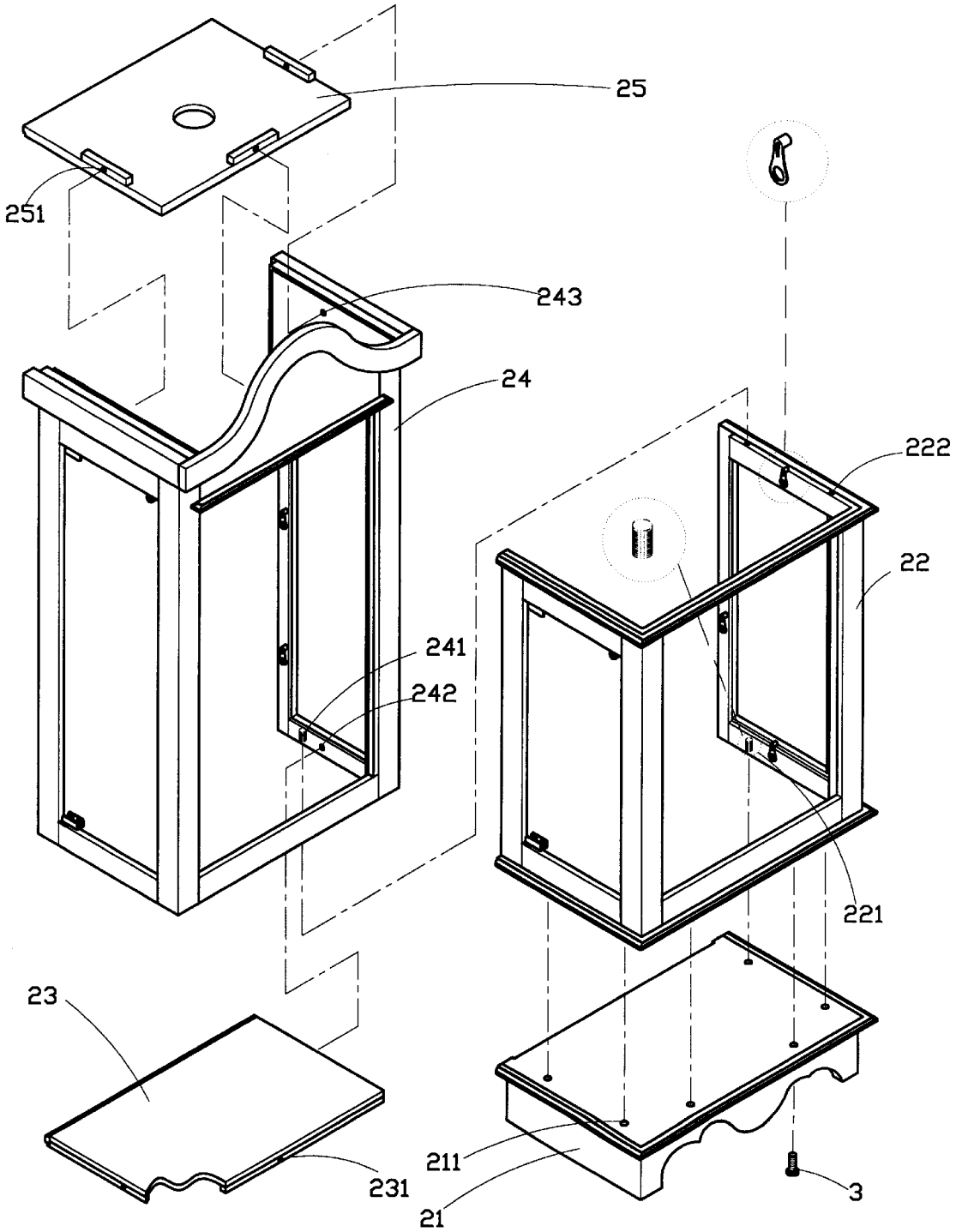
FIG. 3 is an exploded view of the shelf frame body of the invention.

Please refer to FIG. 2, which is a perspective view of the shelf frame body 2 of the invention. The shelf frame body 2 includes a first plate body 21, a first frame body 22, a middle placement plate body 23, a second frame body 24 and a second plate body 25 (please continue to refer to FIG. 3); wherein, the first plate body 21 has six first through holes 211, and the first frame body 22 is shaped as a "U" figure and on its bottom are six first screw holes 221 that include inside threads that match the through holes 221, and at appropriate locations on its top are six second through holes 222. The middle placement plate body 23 has one middle placement through hole 231 each on one of three sides. The second frame body 24 is also shaped as a "U" figure and on its bottom side are six second screw holes 241 that include inner threads that match the second through holes 222, and on the inside of its bottom are three middle placement screw holes 242 that include inner threads that match the middle through holes 231, and at appropriate locations on its top are three third screw holes 243 that include inner threads. Finally, the second plate body 25 has three third through holes 251 that match the third screw holes 243.

Figure 4:
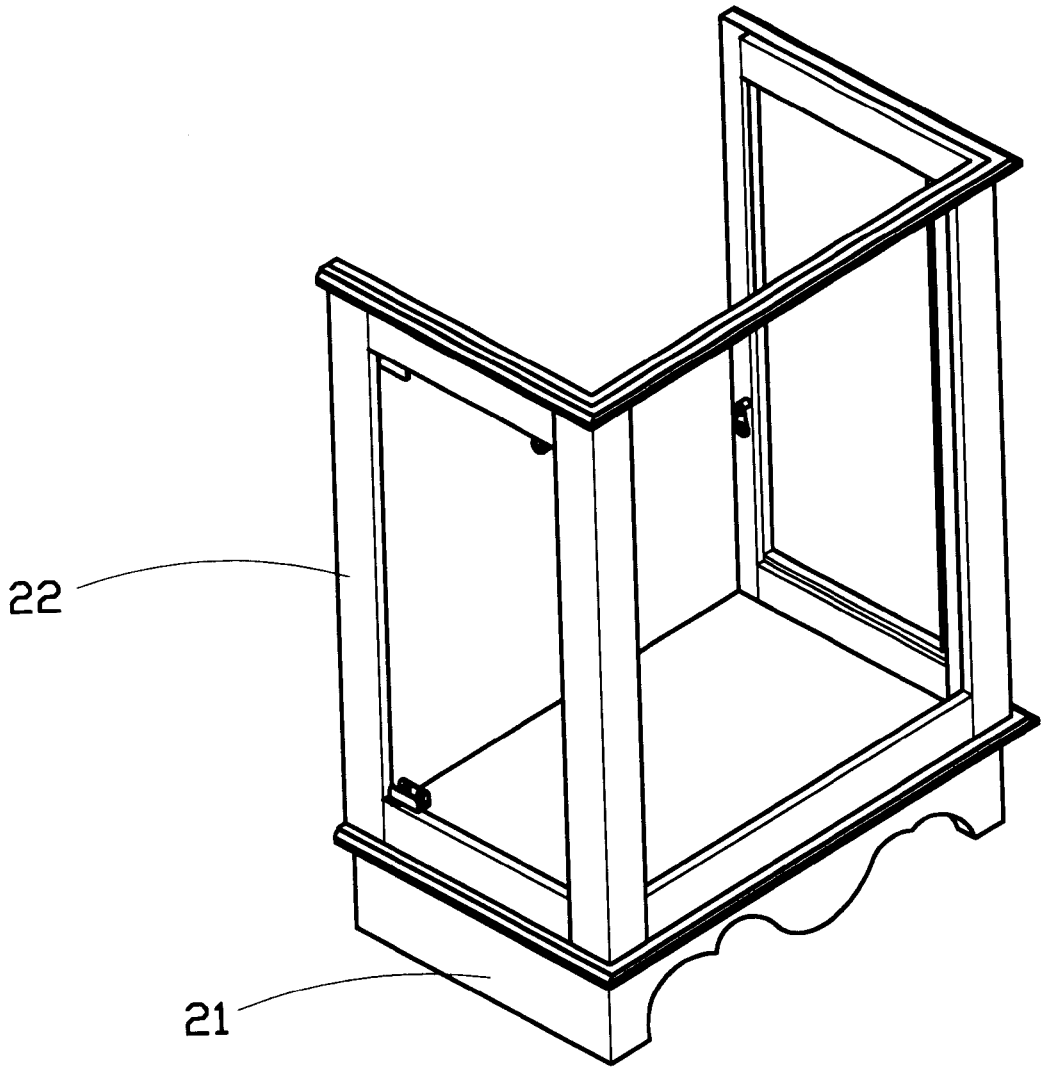
FIG. 4 is a perspective view of an embodiment of a first combination of the shelf frame body in the invention.
Figure 5:
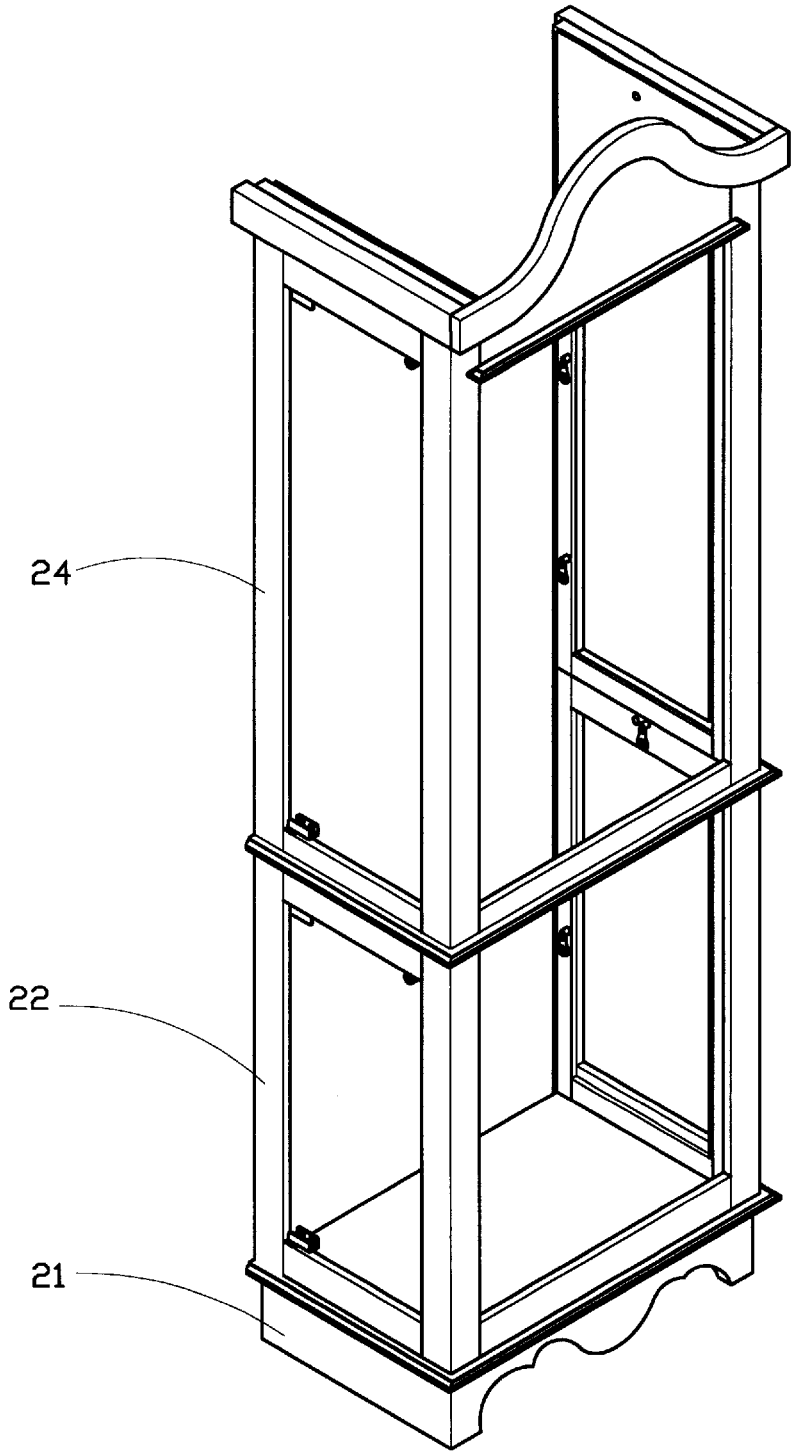
FIG. 5 is a perspective view of an embodiment of a second combination of the shelf frame body in the invention.
Figure 6:
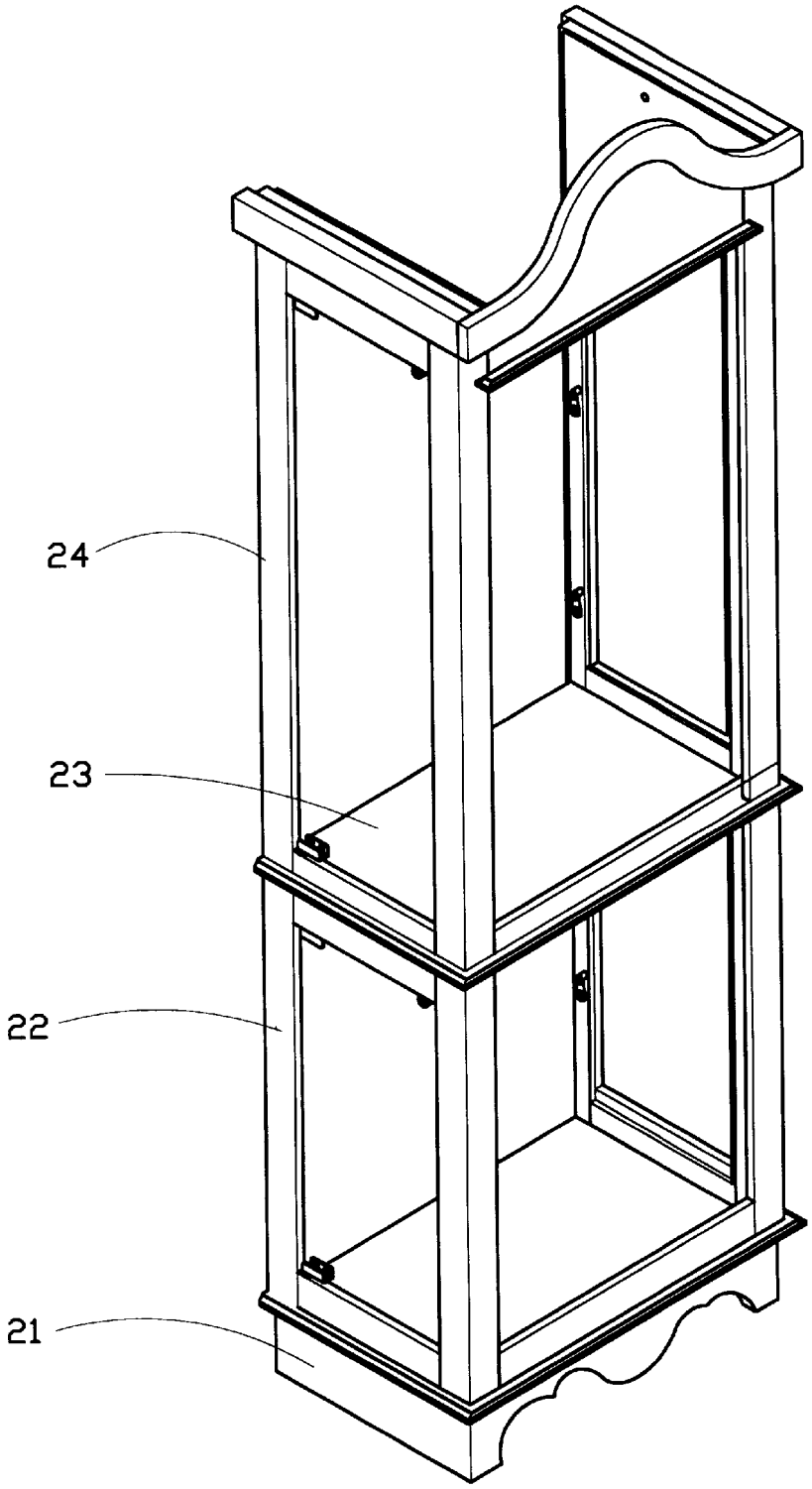
FIG. 6 is a perspective view of an embodiment of a third combination of the shelf frame body in the invention.

When the above structure is assembled, the first plate body 21 can be fixed by fixing six conventional screws 3 to tighten each first through hole 211 with the first screw hole 221 of the first frame body 22, so that the first plate body 21 forms a base (as shown in FIG. 4). Then the first frame body 22 is fixed by several screws 3 that respectively fasten each second through hole 222 with the second screw hole 241, of the second frame body 24 (as shown in FIG. 5). The middle placement plate body 23 is fixed by fastening several screws 3 that respectively fasten each middle placement plate body 231 with the middle screw hole 242 of the second frame body 24, so that the middle placement plate body 23 forms a middle separating plate (as shown in FIG. 6). Finally, the second plate body 25 is fixed by several screws 3 that respectively fasten the third through hole 251 with the third screw hole 243 of the second frame body 24, so that the second plate body 25 forms a top cover (as shown in FIG. 2), completing a shelf frame body 2.

Figure 7:
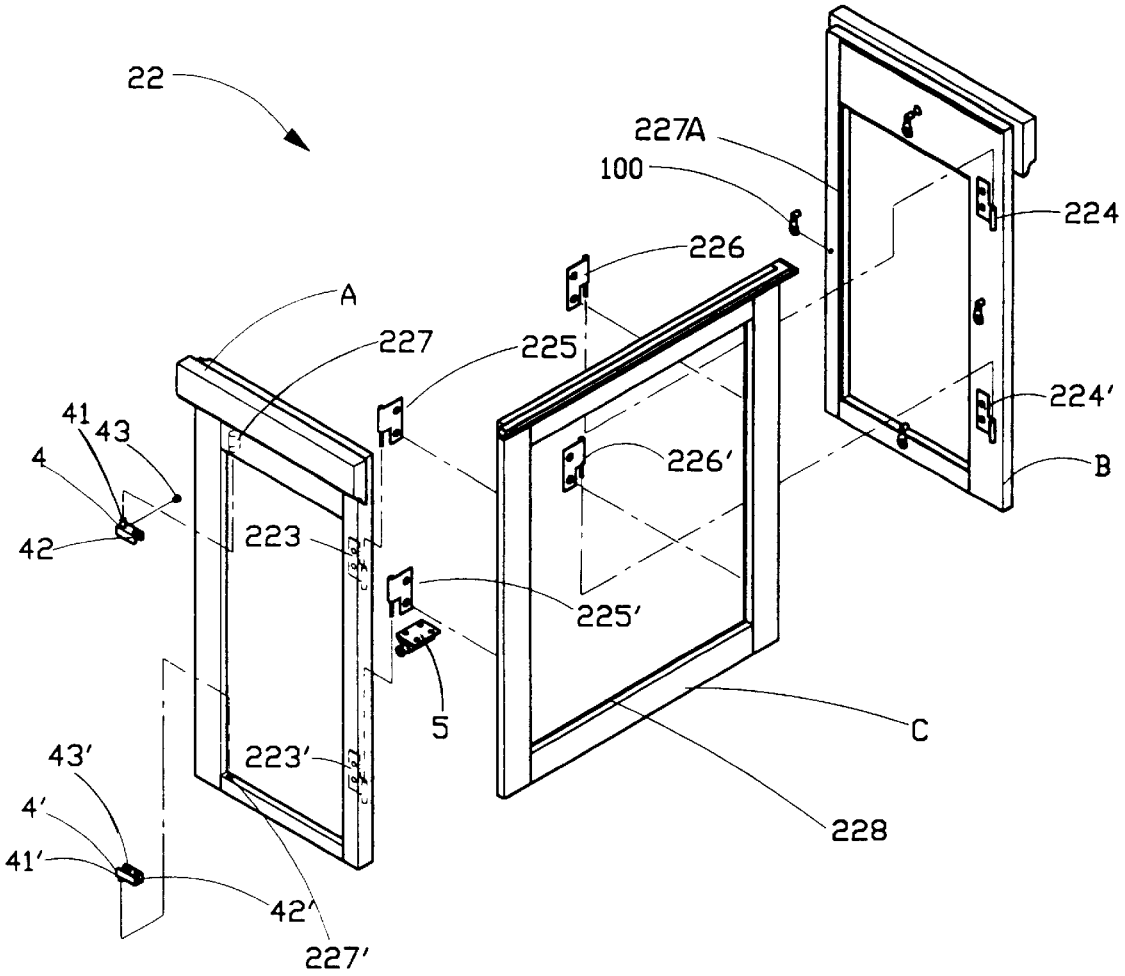
FIG. 7 is a partially exploded view of the first frame unit of the invention.

Referring to FIG. 7, the first frame body 22 includes a first right frame A, a first left frame B and a first front frame C. On the inside left of the first right frame A is a right frame upper female hinge body 223 and a right frame lower female hinge body 223', and on the inside right of the first left frame B is a left frame upper female hinge body 224 and a left frame lower female hinge body 224', and on the inside right of the first front frame C is a front frame right upper male hinge body 225 and a front frame right lower male hinge body 225', which can be mounted on the upper and lower female hinge bodies 223,223' of the first right frame A. On the inside left of the first front frame C are a front frame left upper male hinge body 226 and a front frame left lower male hinge body 226" which can respectively be mounted on the upper and lower female hinge bodies 224,224' of the first left frame B, to assemble a first frame body 22.

Figure 8:
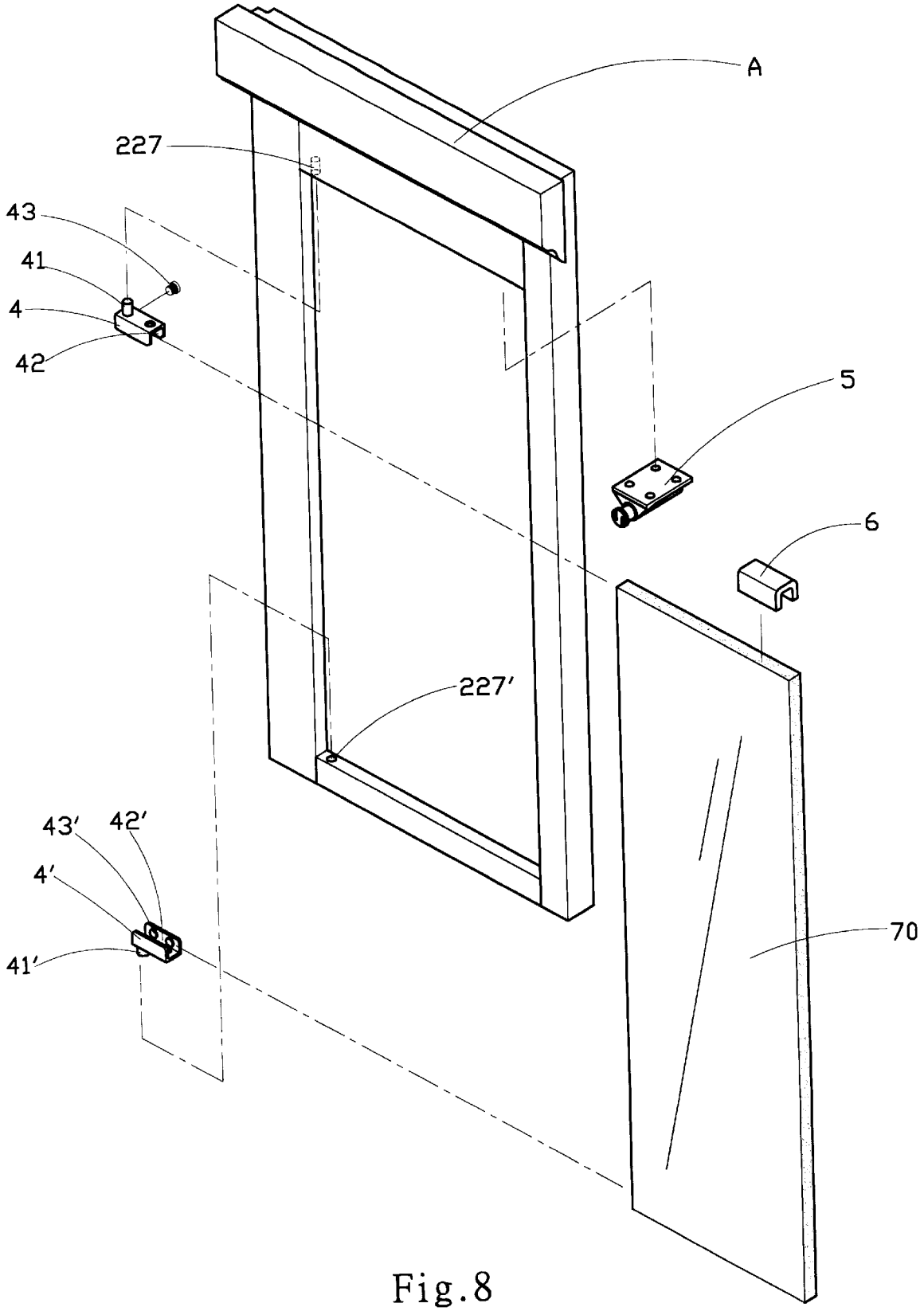
FIG. 8 is an enlarged, partially exploded view of the first right frame.
Figure 9:
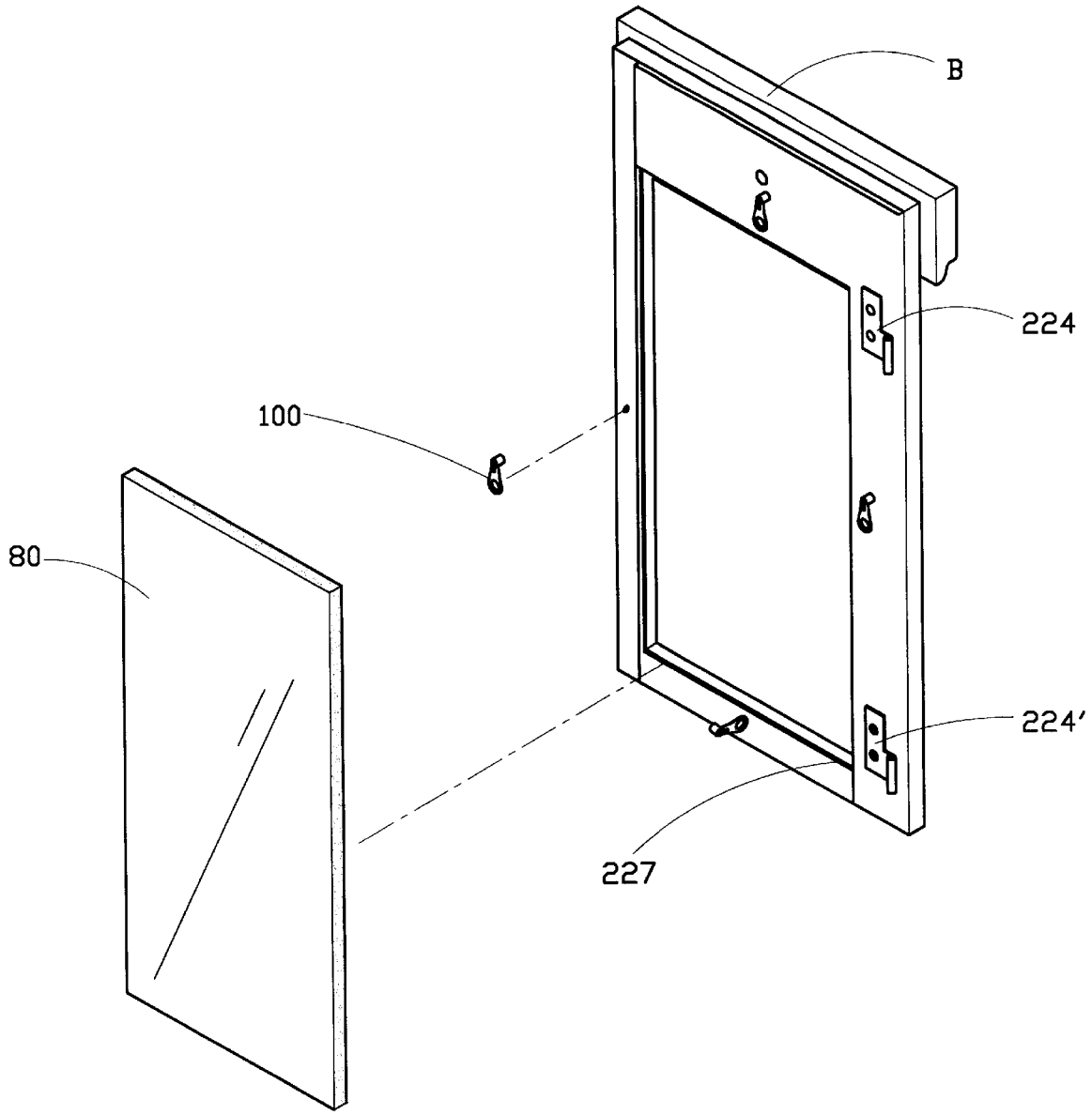
FIG. 9 is an enlarged, partially exploded view of the first left frame.
Figure 10:
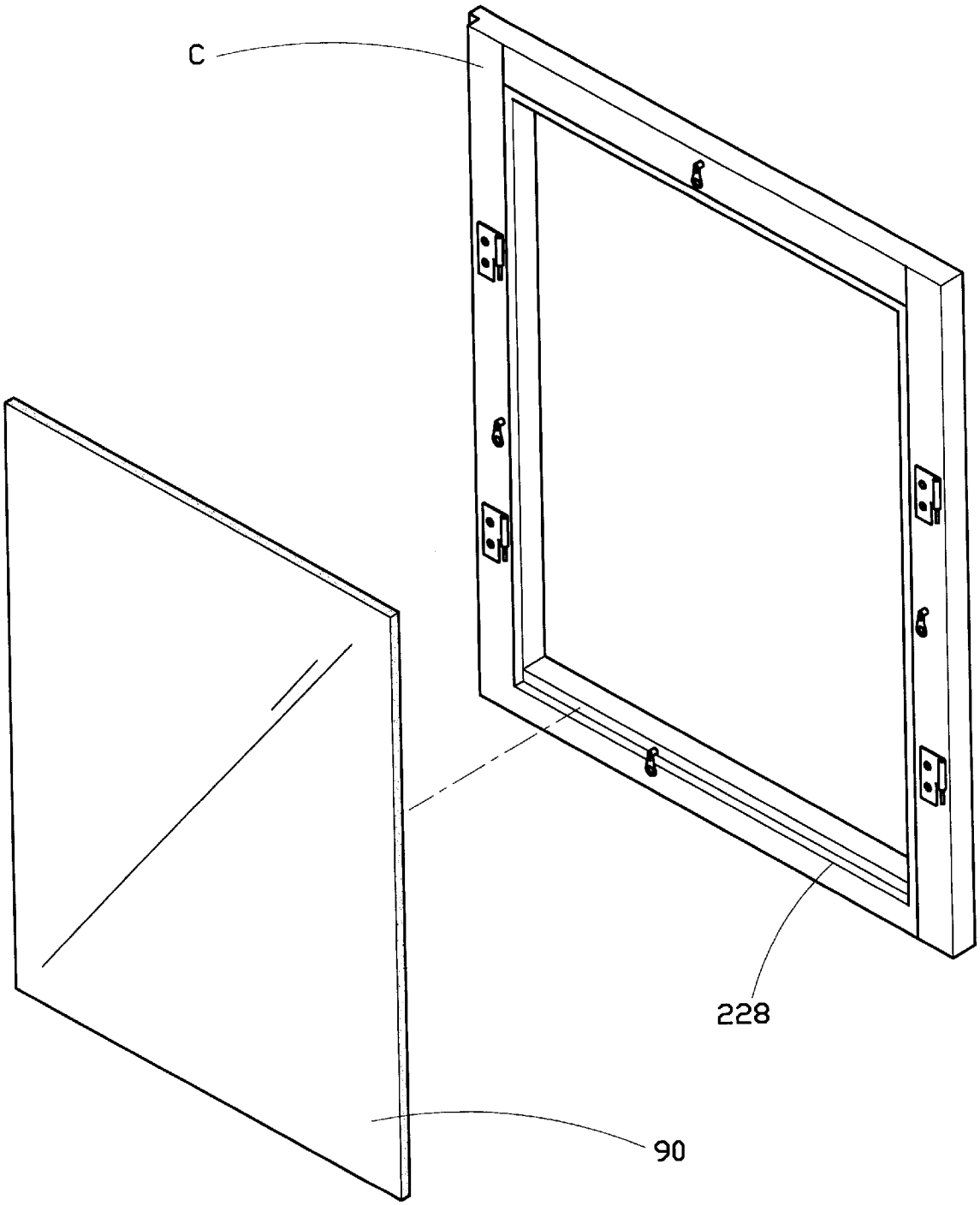
FIG. 10 is an enlarged, partially exploded view of the first front.

Furthermore, on the back inside edge of the first right frame A and corresponding up and down to each other are respectively an upper accommodating hole 227' and a lower accommodating hole 227' (see FIG. 8). Two conventional accommodating turning bodies 4,4' have their protruded shafts 41,41' respectively accommodated in the accommodating holes 227,227', which are able to rotate about the protruded shafts 41,41' as center point of shaft. Then a suitable glass door body 70 has its top edge and bottom edge placed into the corresponding grooves 42,42' of two accommodating turning bodies 4,4'. The respective fastening screws 43,43' are used to fasten the glass door body 70, and on the top of the front of the inner edge of the first right frame A is a conventional magnetic ejecting switch 5, and in the glass door body 70 corresponding to the ejecting switch 5 is a metal plate body 6. On the inside surrounding edge of the first left frame B is a left inside frame channel 227A (see FIG. 9). The surrounding edges of a suitable left window glass body 80 are accommodated in the left inside frame channel 227A, and inside the first left frame body B is installed several conventional blocks 100. The blocks 100 are turned so that the left window glass body 80 is fixed in the left inside frame channel 227A. On the inside surrounding edges of the front frame C is a front inside frame channel 228 (refer to FIG. 10), and likewise, several conventional blocks 100 can fix a front window glass body 90 to the front inside frame channel 228.

Figure 11:
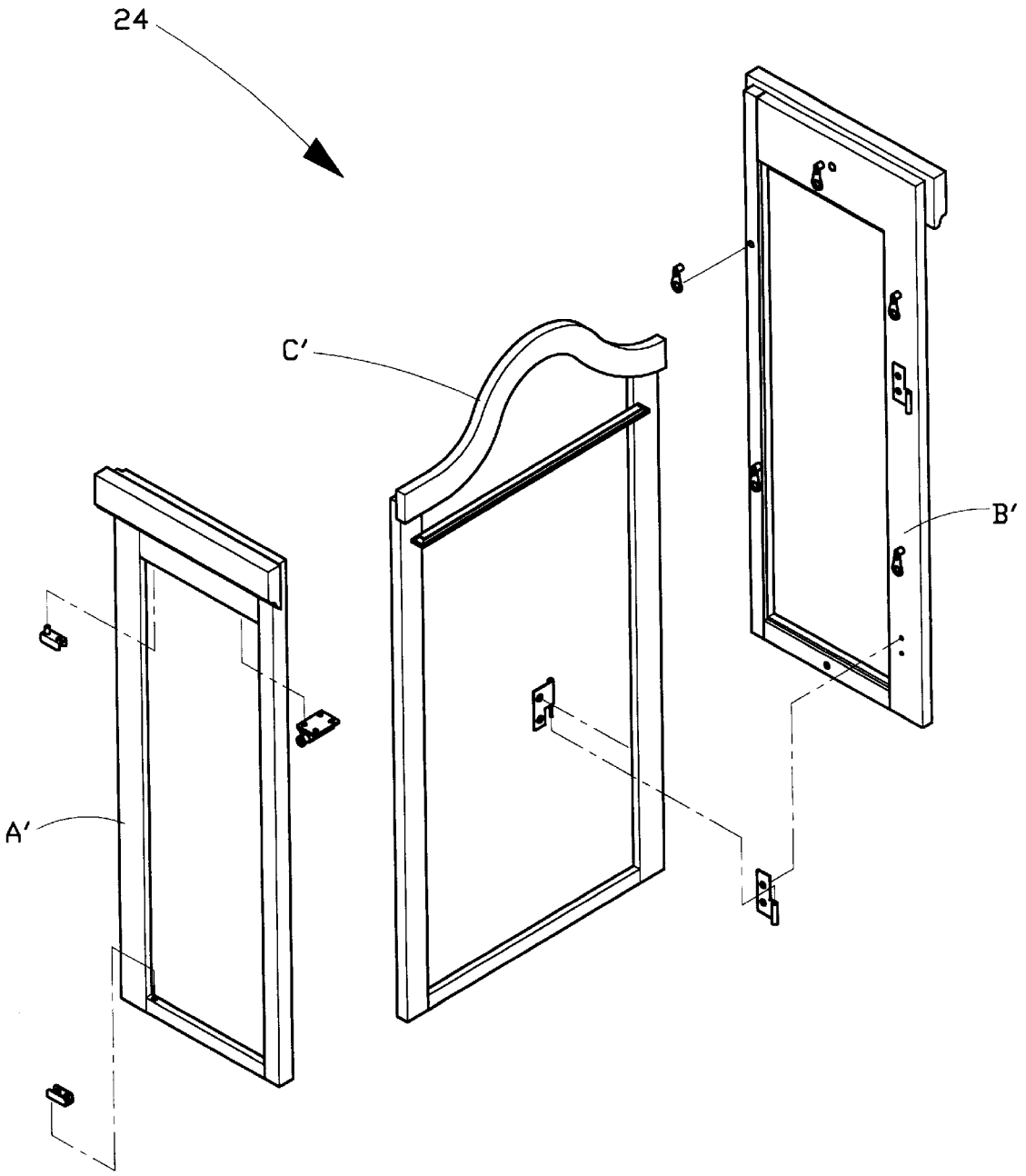
FIG. 11 is a partially exploded view of the second frame unit of the invention.

Referring to FIG. 11, the second frame body 24 includes a second right frame A', a second left frame B' and a second front frame C', and the assembly and construction of the components are the same as the first frame body 22 disclosed above, which needs no elaboration here.

Figure 12:
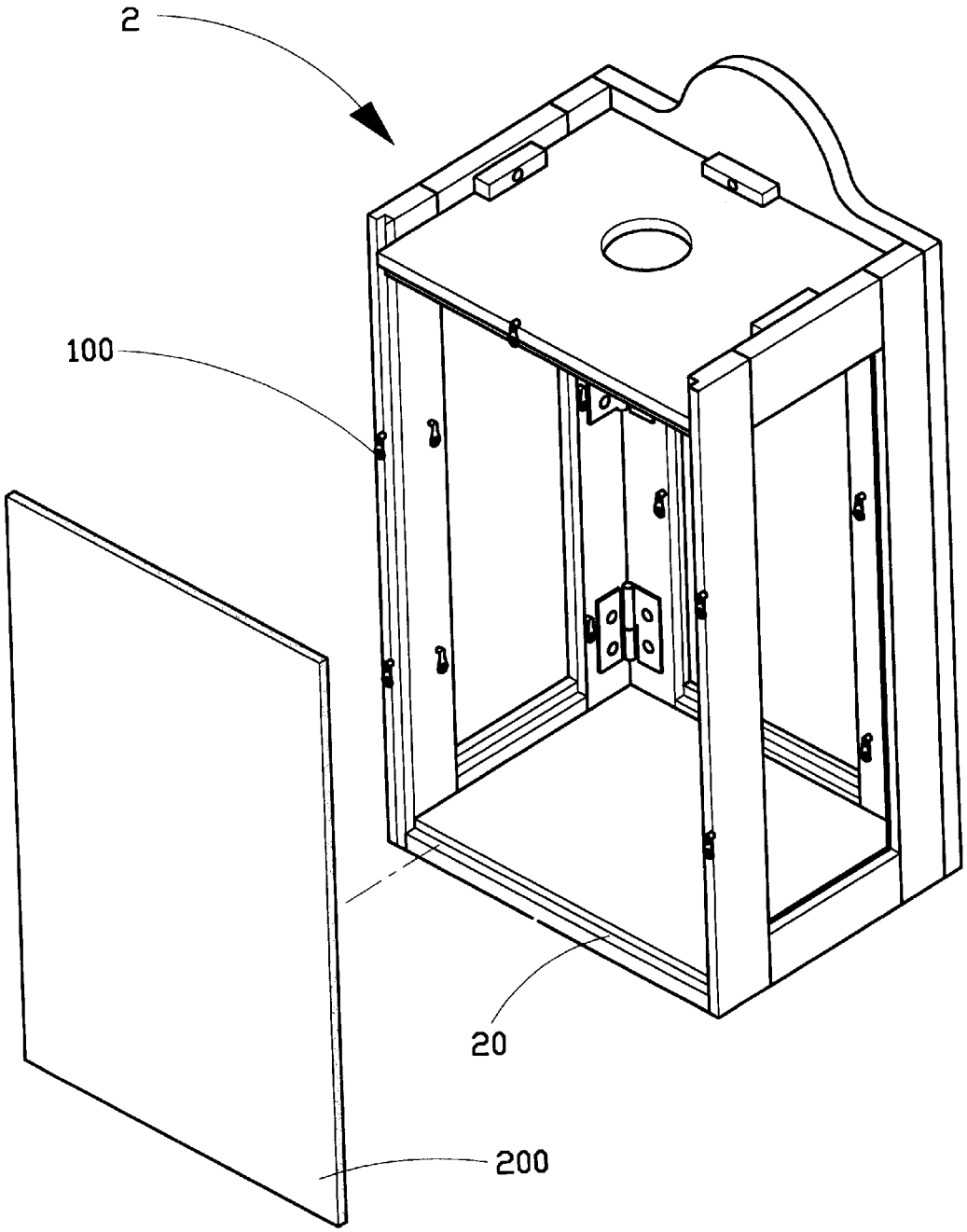
FIG. 12 is an enlarged view of a part of the back structure of the shelf frame body of the invention.

Referring to FIG. 12, which is an enlarged view of a part of the back structure of the shelf frame body 2, at the inside edge on the back of the frame of the frame body 2 is the formation of an inner frame body channel 20, for the accommodation of a suitable mirror glass body 200, where several conventional blocks 100 installed on the back frame are used for fixing purposes.

Finally, the male and female hinge bodies 226,224 joining respective frames A, B, C, A', B' and C' are inserting key type hinge structures that will shorten the time for assembly.

Therefore, as disclosed above, the invention will indeed be easily assembled or disassembled, and it is a "do-it-yourself" product for modern people, so it will achieve the expected efficiency, and the above description covers a preferred embodiment only, so that all equivalent modifications and variations deriving from the description shall be included in the intent and scope of the subject claims.

What is claimed is:

1. A combination type antique display shelf, comprising the following:

a first plate body configured as a base;

a first frame body having three frames to form a first "U" figure, with the bottom part of said first frame body fixed onto said first plate body by conventional screws;

a middle placement plate body configured as a middle separating plate;

a second frame body having three frames to form a second "U" figure, with the bottom part of said second frame body fixed onto the top of said first frame body by conventional screws and forming a joint therebetween, said middle separating plate fixed by conventional screws to the inside of said second frame body at the joint; and a second plate body, roughly in the shape of a top cover, fixed by conventional screws to the inside edge of the top of said second frame body; and regular window glass panes longitudinally secured on said first and second U-shared figures and substantially covering the longitudinal surface areas between the bottom of said first frame body and the top of said second frame body.

2. The combination type antique display shelf, as recited in claim 1, wherein, said first frame body further comprises a U-shaped frame body having a first right frame, a first left frame and a first front frame, joined together by conventional insert-key type hinge devices.

3. The combination type antique display shelf, as recited in claim 1, wherein, said second frame body further comprises a U-shaped frame body having a second right frame, a second left frame and a second front frame, joined together by conventional insert-key type hinge devices.

* * * * *